US009418677B2

(12) United States Patent
Fujieda

(10) Patent No.: US 9,418,677 B2
(45) Date of Patent: Aug. 16, 2016

(54) NOISE SUPPRESSING DEVICE, NOISE SUPPRESSING METHOD, AND A NON-TRANSITORY COMPUTER-READABLE RECORDING MEDIUM STORING NOISE SUPPRESSING PROGRAM

(71) Applicant: Oki Electric Industry Co., Ltd., Tokyo (JP)

(72) Inventor: Masaru Fujieda, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/789,985

(22) Filed: Jul. 1, 2015

(65) Prior Publication Data

US 2016/0042746 A1 Feb. 11, 2016

(30) Foreign Application Priority Data

Aug. 11, 2014 (JP) ..... 2014-163841

(51) Int. Cl.

| | |
|---|---|
| ***G10L 21/00*** | (2013.01) |
| ***G10L 19/00*** | (2013.01) |
| ***G10L 21/0208*** | (2013.01) |
| ***G10L 21/0232*** | (2013.01) |
| *G10L 25/84* | (2013.01) |

(52) U.S. Cl.

CPC ..... *G10L 21/0208* (2013.01); *G10L 21/0232* (2013.01); *G10L 25/84* (2013.01); *G10L 2021/02087* (2013.01)

(58) Field of Classification Search

None

See application file for complete search history.

(56) References Cited

U.S. PATENT DOCUMENTS

| | | | | |
|---|---|---|---|---|
| 6,745,161 | B1 * | 6/2004 | Arnold | G06F 17/30616 704/7 |
| 6,751,776 | B1 * | 6/2004 | Gong | G06F 17/30616 707/E17.028 |
| 2009/0204243 | A1 * | 8/2009 | Marwaha | G06Q 10/10 700/94 |

(Continued)

FOREIGN PATENT DOCUMENTS

| | | |
|---|---|---|
| JP | 2010-055024 A | 3/2010 |
| JP | 2010-160246 A | 7/2010 |

OTHER PUBLICATIONS

Steven F. Boll, "Suppression of Acoustic Noise in Speech Using Spectral Subtraction", IEEE Transactions on Acoustics, Speech, and Signal Processing, vol. ASSP-27, No. 2, Apr. 1979.

(Continued)

*Primary Examiner* — Marcus T Riley

(74) *Attorney, Agent, or Firm* — Rabin & Berdo, P.C.

(57) ABSTRACT

There is provided a noise suppressing device for suppress a noise component included in an input signal. The noise suppressing device comprises: a noise estimating unit configured to estimate a noise spectrum based on an input spectrum obtained by performing a frequency analysis on the input signal; a speech-likelihood calculating unit configured to calculate speech-likelihood based on the input spectrum and the noise spectrum; a suppression-gain calculating unit configured to calculate first suppression gain based on the input spectrum and the noise spectrum; a suppression-gain combining unit configured to calculate third suppression gain by combining the first suppression gain and second suppression gain, which is provided as a predetermined constant value or provided by smoothing the first suppression gain, based on the speech-likelihood; and a multiplying unit obtaining an output spectrum by multiplying the input spectrum by the third suppression gain.

9 Claims, 3 Drawing Sheets

(56) References Cited

U.S. PATENT DOCUMENTS

2010/0056063 A1 3/2010 Sudo
2010/0100371 A1* 4/2010 Yuezhong ..... G06F 17/2881 704/9
2010/0104113 A1* 4/2010 Liu ..... G10L 21/0208 381/94.2
2011/0123045 A1* 5/2011 Tasaki ..... G10L 21/0208 381/94.2
2012/0046936 A1* 2/2012 Kandekar ..... G06Q 30/0282 704/9
2012/0221338 A1* 8/2012 Dow ..... G10L 13/033 704/260
2012/0290637 A1* 11/2012 Perantatos ..... G06Q 10/10 709/203
2014/0122079 A1* 5/2014 Kaszczuk ..... G10L 13/02 704/260
2014/0126745 A1* 5/2014 Dickins ..... H04R 3/002 381/94.3
2015/0215700 A1* 7/2015 Sun ..... H04R 3/002 381/94.2
2015/0230023 A1* 8/2015 Fujieda ..... G10L 21/0232 381/71.1

OTHER PUBLICATIONS

Yariv Ephraim et al., "Speech Enhancement Using a—Minimum Mean-Square Error Short-Time Spectral Amplitude Estimator", IEEE Transactions on Acoustics, Speech, and Signal Processing, vol. ASSP-32, No. 6, Dec. 1984.

* cited by examiner

NOISE SUPPRESSING DEVICE, NOISE SUPPRESSING METHOD, AND A NON-TRANSITORY COMPUTER-READABLE RECORDING MEDIUM STORING NOISE SUPPRESSING PROGRAM

CROSS REFERENCE TO RELATED APPLICATION(S)

This application is based upon and claims benefit of priority from Japanese Patent Application No. 2014-163841, filed on Aug. 11, 2014, the entire contents of which are incorporated herein by reference.

BACKGROUND

The present invention relates to noise suppressing devices, noise suppressing methods, and noise suppressing programs. In particular, the present invention relates to a noise suppressing device, a noise suppressing method, and a noise suppressing program that suppress a noise component mixed with the speech signal by performing processing thereon in the frequency domain.

A spectral subtraction (SS) method for subtracting a spectrum of a noise component (noise spectrum) from a spectrum of an input speech signal (input spectrum) is disclosed in S. F. Boll, "Suppression of acoustic noise using spectral subtraction", IEEE Trans., Acoustics, Speech and Signal Processing, Vol. ASSP-27, No. 2, pp. 113 to 120, April 1979 (referred to as "Non Patent Literature 1" hereinafter).

A minimum mean square error short time spectral amplitude (MMSE-STSA) method for multiplying an input spectrum by spectral gain selected so as to emphasize a speech component is disclosed in Y. Ephraim and D. Malah, "Speech enhancement using a minimum mean-square error short-time spectral amplitude estimator", IEEE ASSP, Vol. ASSP-32, No. 6, pp. 1109 to 1121, December 1984 (referred to as "Non Patent Literature 2" hereinafter).

The methods discussed in Non Patent Literature 1 and Non Patent Literature 2 both require a noise spectrum mixed with an input spectrum. The noise spectrum is separately estimated. The estimated noise spectrum includes an estimation error. Due to the effect of this estimation error, when noise is suppressed in a frequency domain as in the technologies discussed in Non Patent Literature 1 and Non Patent Literature 2, components (isolated frequency components) remain dispersedly along a time axis and a frequency axis in the spectrum (output spectrum) after the suppressing process. These isolated frequency components are perceived by the listener as discordant musical noise.

In order to reduce the aforementioned musical noise, JP 2010-055024A and JP 2010-160246A each disclose a technology for switching between two different noise suppressing methods in accordance with the property of an input spectrum.

The technology discussed in JP 2010-055024A includes section determining means configured to determine whether or not a noise component is dominant in a section, first noise suppressing means configured to collect frequency bands into each group of first group number and to suppress a noise component per each group, and second noise suppressing means configured to collect frequency bands into each group of second group number that is larger than the first group number and to suppress a noise component per each group. If the section determining means determines that "a noise component is dominant", the noise component is suppressed by the first noise suppressing means. If the section determining means determines that "a noise component is not dominant", the noise component is suppressed by the second noise suppressing means. Because the first noise suppressing means has a small number of frequency bins to be grouped into a single group (i.e., has coarse frequency resolution), the occurrence of isolated frequency components is prevented. As a result, musical noise can be reduced, but a speech component becomes distorted. On the other hand, because the second noise suppressing means has a larger number of frequency bins to be grouped than the first group number (i.e., has fine frequency resolution), a speech component is less likely to become distorted. However, since isolated frequency components occur, musical noise occurs in a section where a noise component is dominant. Therefore, the technology discussed in JP 2010-055024A switches between these two noise suppressing means in accordance with whether or not a noise component is dominant in a section, so as to reduce both the occurrence of musical noise and the distortion of a speech component.

The technology discussed in JP 2010-160246A includes kurtosis-index-value calculating means configured to calculate a kurtosis index value indicating a degree by which the kurtosis in the intensity distribution of a speech signal (spectrum) has changed before and after a noise suppressing process, first noise suppressing means configured to use the SS method, and second noise suppressing means configured to use the MMSE-STSA method. A kurtosis index value is calculated for each of the first noise suppressing means and the second noise suppressing means, and a noise component is suppressed by the noise suppressing means with the smaller kurtosis index value. In other words, a kurtosis index value has a positive correlation with the amount of musical noise occurring after a noise-component suppressing process. Therefore, the technology discussed in JP 2010-160246A switches between these two noise suppressing means in accordance with a kurtosis index value so as to reduce the occurrence of musical noise.

SUMMARY

However, when two noise suppressing means are switched simultaneously for all frequency bands as in the technologies discussed in JP 2010-055024A and JP 2010-160246A, the property of an output spectrum drastically changes at the moment when the switching is performed. This may create a problem in which the drastic change is perceived as an unnatural sound signal by the listener.

In the technology discussed in JP 2010-055024A, the frequency bands are grouped, and a common process is performed among the groups. Since this causes the suppression properties to vary greatly among the groups, a problem may occur in which an ultimately obtained output signal becomes distorted.

Furthermore, because the technology discussed in JP 2010-160246A simply involves switching between two noise suppressing means that more or less produce musical noise, a problem may occur in which musical noise cannot be completely suppressed.

Therefore, there is a demand for a noise suppressing device, a noise suppressing method, and a noise suppressing program that can suppress noise without causing distortion, including musical noise, to occur while preventing the listener from perceiving switching of suppression gain.

A noise suppressing device for suppress a noise component included in an input signal according to first embodiment of the present invention comprises: (1) a noise estimating unit configured to estimate a noise spectrum based on an input spectrum obtained by performing a frequency analysis on the input signal; (2) a speech-likelihood calculating unit configured to calculate speech-likelihood based on the input spectrum and the noise spectrum; (3) a suppression-gain calculating unit configured to calculate first suppression gain based on the input spectrum and the noise spectrum; (4) a suppression-gain combining unit configured to calculate third suppression gain by combining the first suppression gain and second suppression gain, which is provided as a predetermined constant value or provided by smoothing the first suppression gain, based on the speech-likelihood; and (5) a multiplying unit configured to obtain an output spectrum by multiplying the input spectrum by the third suppression gain.

A noise suppressing method for suppressing a noise component included in an input signal according to second embodiment of the present invention comprises: (1) causing a noise estimating unit to estimate a noise spectrum based on an input spectrum obtained by performing a frequency analysis on the input signal; (2) causing a speech-likelihood calculating unit to calculate speech-likelihood based on the input spectrum and the noise spectrum; (3) causing a suppression-gain calculating unit to calculate first suppression gain based on the input spectrum and the noise spectrum; (4) causing a suppression-gain combining unit to calculate third suppression gain by combining the first suppression gain and second suppression gain, which is provided as a predetermined constant value or provided by smoothing the first suppression gain, based on the speech-likelihood; and (5) causing a multiplying unit to obtain an output spectrum by multiplying the input spectrum by the third suppression gain.

A non-transitory computer-readable recording medium storing a noise suppressing program for suppressing a noise component included in an input signal according to third embodiment of the present invention is provided, the noise suppressing program causes a computer to function as: (1) a noise estimating unit configured to estimate a noise spectrum based on an input spectrum obtained by performing a frequency analysis on the input signal; (2) a speech-likelihood calculating unit configured to calculate speech-likelihood based on the input spectrum and the noise spectrum; (3) a suppression-gain calculating unit configured to calculate first suppression gain based on the input spectrum and the noise spectrum; (4) a suppression-gain combining unit configured to calculate third suppression gain by combining the first suppression gain and second suppression gain, which is provided as a predetermined constant value or provided by smoothing the first suppression gain, based on the speech-likelihood; and (5) a multiplying unit configured to obtain an output spectrum by multiplying the input spectrum by the third suppression gain.

According to the embodiments of the present invention, noise can be suppressed without causing distortion, including musical noise, to occur while preventing the listener from perceiving switching of suppression gain.

DETAILED DESCRIPTION OF THE EMBODIMENTS

Figure 1:
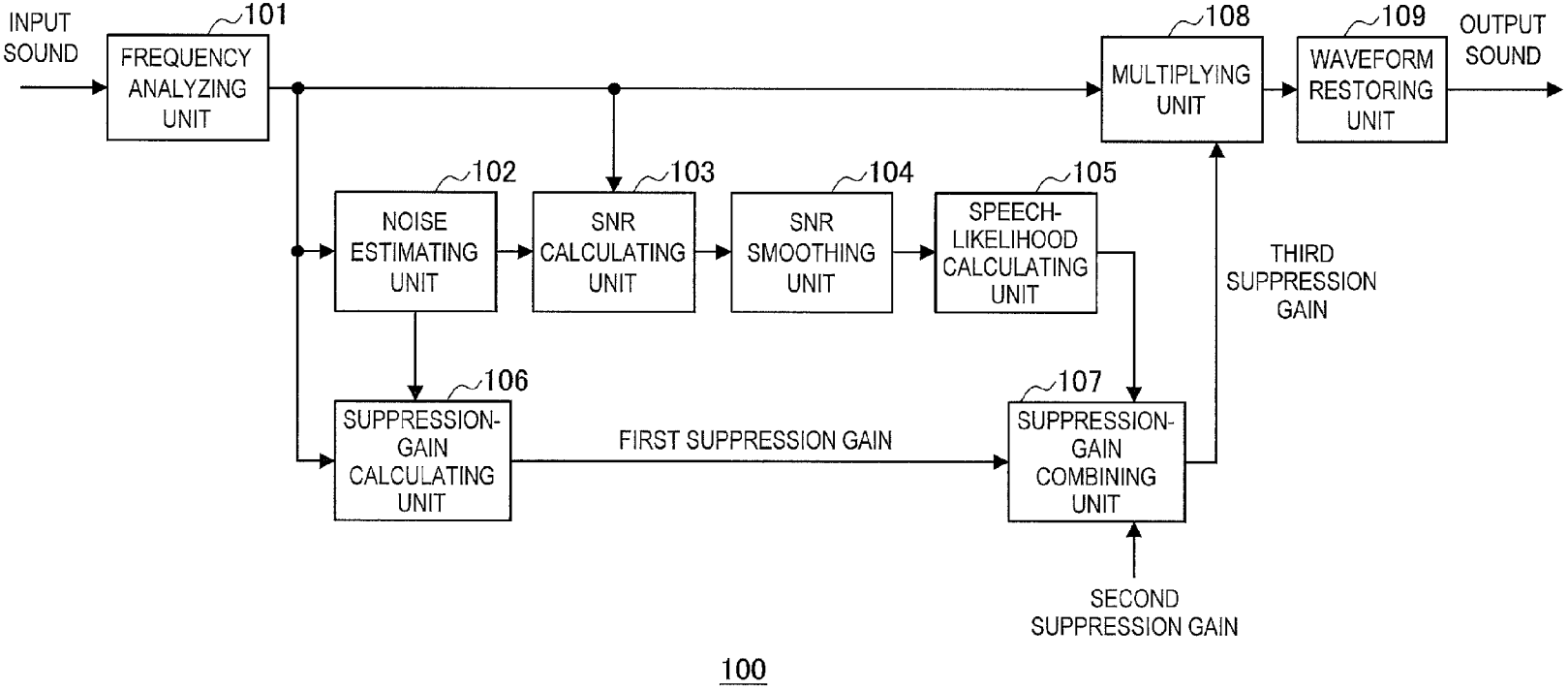
FIG. 1 is a block diagram illustrating an internal configuration of a noise suppressing device according to a first embodiment.

Hereinafter, referring to the appended drawings, preferred embodiments of the present invention will be described in detail. It should be noted that, in this specification and the appended drawings, structural elements that have substantially the same function and structure are denoted with the same reference numerals, and repeated explanation thereof is omitted.

(A) First Embodiment

A noise suppressing device, a noise suppressing method, and a noise suppressing program according to first embodiment of the present invention will be described in detail below with reference to the drawings.

(A-1) Configuration of First Embodiment

FIG. 1 is a block diagram illustrating an internal configuration of a noise suppressing device according to the first embodiment. Although a noise suppressing device 100 according to the first embodiment can be realized by software (noise suppressing program) executed by a central processing unit (CPU) or can be realized by using an electronic circuit, such as a digital signal processor (DSP), an application specific integrated circuit (ASIC), or a programmable logic device (PLD), the noise suppressing device 100 can be functionally expressed by FIG. 1. FIG. 1 can also be viewed as a flowchart illustrating the flow of a noise suppressing process in the noise suppressing device 100 according to the first embodiment.

In FIG. 1, the noise suppressing device 100 according to the first embodiment has a frequency analyzing unit 101, a noise estimating unit 102, a signal-to-noise-ratio (SNR) calculating unit 103, an SNR smoothing unit 104, a speech-likelihood calculating unit 105, a suppression-gain calculating unit 106, a suppression-gain combining unit 107, a multiplying unit 108, and a waveform restoring unit 109.

The noise suppressing device 100 receives input sound constituted of a digital sound signal. For example, the input sound may be a signal digitally converted by an analog/digital (A/D) converter from an analog sound signal obtained by capturing sound using a microphone. Alternatively, the input sound may be a digital sound signal transferred via a communication line. As another alternative, the input sound may be a digital sound signal read from a storage medium.

The frequency analyzing unit 101 calculates an input spectrum by performing a frequency analysis on the input sound based on a predetermined frequency analysis method. The frequency analysis method is not limited in particular, and various methods may be widely applied. For example, a fast Fourier transform (FFT) method is preferred. This embodiment relates to a case where the FFT method is used. However, the frequency analysis method is not limited to this method. For example, a wavelet transform method or a quadrature mirror filter bank method may be used in place of the FFT method.

Furthermore, the input spectrum obtained by the frequency analyzing unit 101 consists of complex numbers. A spectrum obtained by calculating the power in each frequency band of the input spectrum will be referred to as "input power spectrum" hereinafter.

The frequency analyzing unit 101 supplies the obtained input spectrum to the noise estimating unit 102, the SNR calculating unit 103, the suppression-gain calculating unit 106, and the multiplying unit 108.

The noise estimating unit 102 estimates a noise component included in the input spectrum from the frequency analyzing unit 101 for each frequency band and calculates a noise power spectrum for each frequency band. Moreover, the noise estimating unit 102 supplies the obtained noise power spectrum to the SNR calculating unit 103 and the suppression-gain calculating unit 106.

The noise estimating method used in the noise estimating unit 102 may be a technology discussed in, for example, R. Martin, "Spectral Subtraction based on minimum statistics", in Proc. EUSIPCO, pp. 1182 to 1185, 1994, but is not limited thereto. Most noise estimating methods involve calculating a noise "POWER" spectrum. If a noise spectrum is necessary, the noise spectrum may be obtained by calculating the square root of the noise power spectrum in each frequency band and constructing it as a spectrum. Furthermore, if the noise estimating method used involves calculating a noise spectrum, in order to obtain a noise power spectrum, a spectrum obtained by calculating the power in each frequency band of the noise spectrum may be used as the noise power spectrum. When using either method, each frequency band of the noise spectrum is provided as a real value expressing the amplitude.

The SNR calculating unit 103 receives the input power spectrum from the frequency analyzing unit 101 and the noise power spectrum from the noise estimating unit 102 and divides the input power spectrum by the noise power spectrum so as to calculate an SNR for each frequency band. The SNR calculating unit 103 supplies the obtained SNR to the SNR smoothing unit 104. The first embodiment relates to a case where the SNR calculating unit 103 calculates an SNR by dividing the input power spectrum as an observation signal by the noise power spectrum. Alternatively, the SNR calculating unit 103 may perform the calculation by dividing a power spectrum of a speech component by the input power spectrum as an observation signal.

The SNR smoothing unit 104 calculates a smoothed SNR by smoothing the SNR supplied from the SNR calculating unit 103 along both a frequency-axis direction and a time-axis direction. The SNR smoothing unit 104 supplies the obtained smoothed SNR to the speech-likelihood calculating unit 105. By smoothing the SNR, which serves as a material to be used for calculating speech-likelihood, along both the frequency-axis direction and the time-axis direction, a drastic change in the property of ultimate third suppression gain to be calculated by the suppression-gain combining unit 107, to be described later, can be suppressed, whereby unnaturalness in audibility can be further suppressed.

For the SNR smoothing unit 104 smooths the SNR along both the frequency-axis direction and the time-axis direction, the SNR smoothing unit 104 may perform the smoothing along either one of the frequency-axis direction and the time-axis direction first, or may perform the smoothing simultaneously along the frequency-axis direction and the time-axis direction. However, a configuration in which the smoothing of the SNR is performed along the time-axis direction after smoothing along the frequency-axis direction is preferably used.

Furthermore, the smoothing method used for the frequency-axis direction and the time-axis direction may be the same or may be different therebetween. Although the smoothing method for each of the frequency-axis direction and the time-axis direction is not limited whatsoever and various kinds of methods may be used, it is preferable that a moving average method be used for smoothing along the frequency-axis direction, and that a time constant filter be used for smoothing along the time-axis direction. In a case where the smoothing is performed simultaneously in both directions, the smoothing can be realized by using a two-dimensional filter. The moving average method and the time constant filter will be briefly described below.

The moving average method can be expressed by equation (1), assuming that a value to be smoothed is defined as $p_i$ (i=0, 1, 2, . . . , (I−1)), a smoothing window is defined as $w_j$ (j=−$J_1$, . . . , $J_2$), and a smoothed value is defined as $q_i$. The length of the smoothing window is expressed as $J=J_1+J_2+1$ when $I>0$, $J_1>0$, and $J_2>0$, and $\min\{\alpha, \beta\}$ in equation (1) expresses operation in which the smaller one of $\alpha$ and $\beta$ is selected. The smoothing window is calculated using a rectangular window function or a hamming window function. In a case where the moving average method is used for smoothing along the frequency-axis direction, it is desirable that $J_1=J_2$, and it is preferable that the degree of smoothing be set such that J is a length equivalent from 200 Hz to 400 Hz. In a case where the moving average method is used for smoothing along the time-axis direction, a future value is not used when $J_1=0$, and it is preferable that the degree of smoothing be set such that $J=J_2+1$ is a length equivalent from 50 msec to 100 msec.

$$q_i = \frac{\sum_{j=-\min\{J_1, I-1-i\}}^{\min\{J_2, i\}} w_j \cdot p_{i-j}}{\sum_{j=-\min\{J_1, I-1-i\}}^{\min\{J_2, i\}} w_j} \tag{1}$$

The time constant filter can be can be expressed by equation (2), assuming that a value to be smoothed is defined as $p_i$, a time constant is defined as c (0<c<1), and a smoothed value is defined as $q_i$. In equation (2), the degree of smoothing intensifies as the time constant c approaches 1, and a smoother value is obtained. Although preferably used for smoothing along the time-axis direction, the time constant filter is not often used along the frequency-axis direction. When using the time constant filter for smoothing along the time-axis direction, it is preferable that the degree of smoothing be set such that the time constant c is from about 0.7 to about 0.9.

$$q_i=p_i+c(q_{i-1}-p_i) \tag{2}$$

The speech-likelihood calculating unit 105 calculates speech-likelihood by converting the smoothed SNR supplied from the SNR smoothing unit 104 using a predetermined weakly-monotonically-increasing nonlinear function. The speech-likelihood calculating unit 105 supplies the obtained speech-likelihood to the suppression-gain combining unit 107.

The speech-likelihood refers to the degree of existence of a speech component within an input spectrum of each frequency band. In the first embodiment, the speech-likelihood calculating unit 105 calculates the degree of existence of a speech component within an input spectrum of each frequency band by converting the smoothed SNR supplied from the SNR smoothing unit 104 into a value of a nonlinear function.

Figure 2:
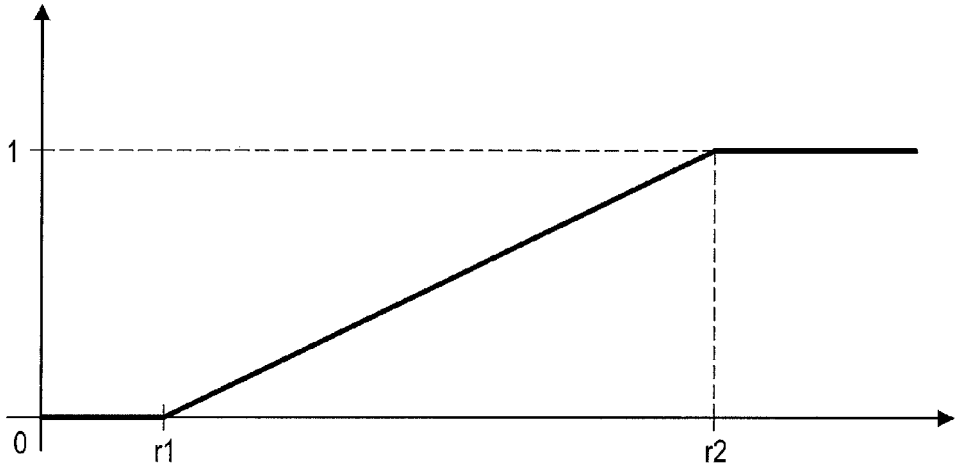
FIG. 2 illustrates an example of a nonlinear function used in a speech-likelihood calculating unit according to the first embodiment.

FIG. 2 illustrates the nonlinear function used in the speech-likelihood calculating unit 105 according to the first embodiment.

In FIG. 2, the ordinate axis indicates a value of the nonlinear function, whereas the abscissa axis indicates a value of the smoothed SNR. The nonlinear function in FIG. 2 is a weakly-monotonically-increasing function, and the speech-likelihood is limited to a value ranging between 0 and 1. In FIG. 2, when the value of the smoothed SNR ranges from r1 to r2, the value of the nonlinear function ranges between 0 and 1 as the value of the smoothed SNR increases. When the value of the smoothed SNR is smaller than or equal to r1, the value of the nonlinear function becomes 0. When the value of the smoothed SNR is larger than or equal to r2, the value of the nonlinear function becomes 1.

Although the speech-likelihood calculating unit 105 preferably converts the SNR into speech-likelihood by using, for example, the nonlinear function shown in FIG. 2, the speech-likelihood calculating unit 105 may alternatively calculate speech-likelihood by using an arbitrary weakly-monotonously-increasing function. In particular, when limited to functions with a value range between 0 and 1, the use of a sigmoid function is also a good selection. In FIG. 2, it is preferable that r1 be a value ranging from about 1 to about 4 and that r2 be a value ranging from about 12 to about 20.

The SNR calculating unit 103 may determine a value by dividing a power spectrum of a speech component by an input power spectrum as an observation signal. Even in that case, the SNR smoothing unit 104 smooths the output from the SNR calculating unit 103 along the frequency-axis direction and the time-axis direction. In this case, the speech-likelihood calculating unit 105 may convert the smoothed value into a value of a nonlinear function for each frequency band by using a predetermined weakly-monotonically-increasing nonlinear function in a manner similar to the above.

For each frequency band, the suppression-gain calculating unit 106 calculates first suppression gain by using the input power spectrum from the frequency analyzing unit 101 and the noise power spectrum from the noise estimating unit 102. The suppression-gain calculating unit 106 supplies the obtained first suppression gain to the suppression-gain combining unit 107.

For each frequency band, the suppression-gain combining unit 107 combines the first suppression gain from the suppression-gain calculating unit 106 and second suppression gain, which is a predetermined constant value set in advance, based on the speech-likelihood so as to calculate third suppression gain. The suppression-gain combining unit 107 supplies the obtained third suppression gain to the multiplying unit 108.

The multiplying unit 108 multiplies the input spectrum of each frequency band from the frequency analyzing unit 101 by the third suppression gain for each frequency band from the suppression-gain combining unit 107 so as to calculate an output spectrum. The multiplying unit 108 supplies the obtained output spectrum to the waveform restoring unit 109.

The waveform restoring unit 109 performs waveform restoration in correspondence with the frequency analysis method by the frequency analyzing unit 101 and converts the output spectrum output from the multiplying unit 108 into a time waveform so as to obtain an output sound. The waveform restoring unit 109 outputs the obtained output sound signal as an output signal of the noise suppressing device 100. For example, if the frequency analyzing unit 101 uses the FFT method, the waveform restoring unit 109 restores a waveform by using an inverse fast Fourier transform (IFFT) method.

(A-2) Operation of First Embodiment

Next, the noise suppressing method in the noise suppressing device 100 according to the first embodiment will be described with reference to FIG. 1.

Input sound input to the noise suppressing device 100 is supplied to the frequency analyzing unit 101. The frequency analyzing unit 101 calculates an input spectrum from the input sound in accordance with a predetermined frequency analysis method. The obtained input spectrum is supplied to the multiplying unit 108, the SNR calculating unit 103, the noise estimating unit 102, and the suppression-gain calculating unit 106.

For each frequency band, the noise estimating unit 102 estimates a noise component included in the input spectrum of each frequency band in accordance with a predetermined noise estimating method and calculates a noise power spectrum of the estimated noise component. The obtained noise power spectrum of each frequency band is supplied to the SNR calculating unit 103 and the suppression-gain calculating unit 106.

For each frequency band, the SNR calculating unit 103 divides an input power spectrum by the noise power spectrum so as to calculate an SNR in each frequency band. This SNR in each frequency band is supplied to the SNR smoothing unit 104.

In order to suppress unnaturalness in audibility, the SNR smoothing unit 104 smooths the SNR from the SNR calculating unit 103 along both the frequency-axis direction and the time-axis direction so as to calculate a smoothed SNR. The obtained smoothed SNR is supplied to the speech-likelihood calculating unit 105.

Although the smoothing methods used for the frequency-axis direction and the time-axis direction by the SNR smoothing unit 104 are not particularly limited, as described above, the example here relates to a case where, for example, the moving average method is used for smoothing along the frequency-axis direction and the time constant filter is used for smoothing along the time-axis direction. In this case, the smoothing along the frequency-axis direction performed by the SNR smoothing unit 104 can be expressed by equation (1), assuming that a value to be smoothed is defined as $p_i$ (i=0, 1, . . . , (I−1)), a smoothing window is defined as $w_j$ ($j=-J_1, \ldots, J_2$), and a smoothed value is defined as $q_i$. With I>0, $J_1>0$, $J_2>0$, and $J_1=J_2$ in equation (1) and the length $J=J_1+J_2+1$ of the smoothing window being a length corresponding to from about 200 Hz to about 400 Hz, the smoothing along the frequency-axis direction is performed. Moreover, the smoothing along the time-axis direction can be expressed by equation (2), assuming that a value to be smoothed is defined as $p_i$, a time constant is defined as c (0<c<1), and a smoothed value is defined as $q_i$. Then, the smoothing along the time-axis direction is performed with the time constant c being from about 0.7 to about 0.9.

The speech-likelihood calculating unit 105 converts the smoothed SNR into speech-likelihood by using a predetermined weakly-monotonically-increasing nonlinear function. The obtained speech-likelihood is supplied to the suppression-gain combining unit 107.

For example, as shown in FIG. 2, the weakly-monotonically-increasing nonlinear function used is of a type in which speech-likelihood $b_k$ is limited to a range between 0 and 1 within a range in which the value of the smoothed SNR is from r1 to r2. In this case, r1 in FIG. 2 is preferably from about 1 to about 4, and r2 is preferably from about 12 to about 20.

For each frequency band, the suppression-gain calculating unit 106 calculates first suppression gain by using the input power spectrum and the noise power spectrum. The obtained first suppression gain for each frequency band is supplied to the suppression-gain combining unit 107.

With regard to the method of calculating the first suppression gain by the suppression-gain calculating unit 106, for example, the SS method disclosed in Non Patent Literature 1 or the MMSE-STSA method disclosed in Non Patent Literature 2 may be used. The SS method involves a small calculation amount but generates a large amount of musical noise. On the other hand, the MMSE-STSA method generates a small amount of musical noise but involves a large calculation amount. In the first embodiment, it is preferable to use the SS method that involves a small calculation amount since distortion in a section where a speech component does not exist can be completely suppressed.

This embodiment relates to a case where the suppression-gain calculating unit 106 calculates the first suppression gain by using the SS method. For example, first suppression gain $G_k$ can be expressed by equation (3), assuming that an input spectrum is defined as $X_k$, a noise spectrum is defined as $D_k$, suppression gain based on the SS method is defined as $G_k$, a suppression coefficient is defined as a, and minimum suppression gain (i.e., a maximum suppression amount), which is a minimum value of suppression gain, is defined as $G_{min}$. In this case, k denotes a number indicating a frequency band, and $\max\{\alpha, \beta\}$ expresses calculation in which the larger one of $\alpha$ and $\beta$ is selected. Generally, for suppressing musical noise, it is preferable that a value smaller than 1 be used as a and that $G_{min}$, be a value of about 0.25 (equivalent to −12 dB). On the other hand, in the noise suppressing device 100 according to the first embodiment, since musical noise is not generated, as will be described later, it is preferable that a=1 and that a small value be used as $G_{min}$, such as 0.1 (a suppression amount equivalent to −20 dB) or 0.01 (a suppression amount equivalent to −40 dB).

$$G_k = \max\left\{1 - \frac{a \cdot D_k}{|X_k|}, G_{min}\right\} \tag{3}$$

The suppression-gain combining unit 107 is supplied with the speech-likelihood $b_k$ from the speech-likelihood calculating unit 105, the first suppression gain $G_k$ from the suppression-gain calculating unit 106, and second suppression gain F, which is a predetermined constant value. For example, the suppression-gain combining unit 107 calculates third suppression gain $H_k$ by using equation (4). The obtained third suppression gain $H_k$ is supplied to the multiplying unit 108.

$$H_k = b_k \cdot G_k + (1 - b_k)F \tag{4}$$

Although an arbitrary constant value can be set as the second suppression gain F, minimum suppression gain of the SS method is preferably used due to the following reasons. Specifically, when $F > G_{min}$ in equation (4), since a section where a speech component exists is suppressed more intensely than a section where a speech component does not exist, the speech component is unnaturally emphasized. When $F < G_{min}$, a noise component remaining in the section where the speech component exists after suppressing the noise component is unnaturally perceived by the listener. The second suppression gain F may be stored in a storage unit (not shown) or may be set by user operation where appropriate.

As described above, the speech-likelihood $b_k$ is a real number ranging between 0 and 1. Therefore, since the first suppression gain $G_k$ and the second suppression gain F are to be multiplied by a coefficient provided as a real number ranging between 0 and 1, unnaturalness caused by a drastic change in the property of the third suppression gain $H_k$ is not perceived by the listener.

The speech-likelihood $b_k$ is calculated for each frequency band. Therefore, since the combination ratio between the first suppression gain $G_k$ and the second suppression gain F varies from frequency band to frequency band, unnaturalness caused by switching of the suppression gain is not perceived by the listener.

Because the second suppression gain F is a constant value, multiplication of the second suppression gain F simply causes the volume of the input sound signal to change, meaning that distortion does not occur at all. Therefore, in a section where speech exists, a speech component is emphasized by multiplication of the first suppression gain $G_k$, so that the sound quality on a par with that in the related art is achieved. In a section where speech does not exist, the volume is reduced by multiplication of the second suppression gain F, so that signal distortion (including musical noise) does not occur at all.

The multiplying unit 108 calculates an output spectrum by multiplying the input spectrum of each frequency band from the frequency analyzing unit 101 by the third suppression gain for each frequency band from the suppression-gain combining unit 107, and supplies the obtained output spectrum to the waveform restoring unit 109.

The waveform restoring unit 109 obtains an output sound signal by converting the output spectrum from the multiplying unit 108 into a time waveform. The output sound signal is then output as an output signal of the noise suppressing device 100.

(A-3) Effects of First Embodiment

According to the first embodiment described above, the sound quality on a par with that in the related art can be achieved while a speech component is emphasized in a section where the speech component exists, and distortion of an output signal does not occur at all in a section where a speech component does not exist.

(B) Second Embodiment

Next, a noise suppressing device, a noise suppressing method, and a noise suppressing program according to second embodiment of the present invention will be described in detail with reference to the drawings.

The first embodiment described above relates to a case where the second suppression gain is a predetermined constant value set in advance. However, since the way of suppressing noise in a section where a speech component exists in accordance with the first suppression gain varies depending on the properties of a speech component and a noise component included in an input signal, the use of the second suppression gain, whose value does not change, causes a difference in sound quality to occur between a section where a speech component exists and a section where a speech component does not exist.

In the second embodiment, the second suppression gain is calculated based on the first suppression gain so as to prevent a difference in sound quality from occurring between a section where a speech component exists and a section where a speech component does not exist.

(B-1) Configuration of Second Embodiment

Figure 3:
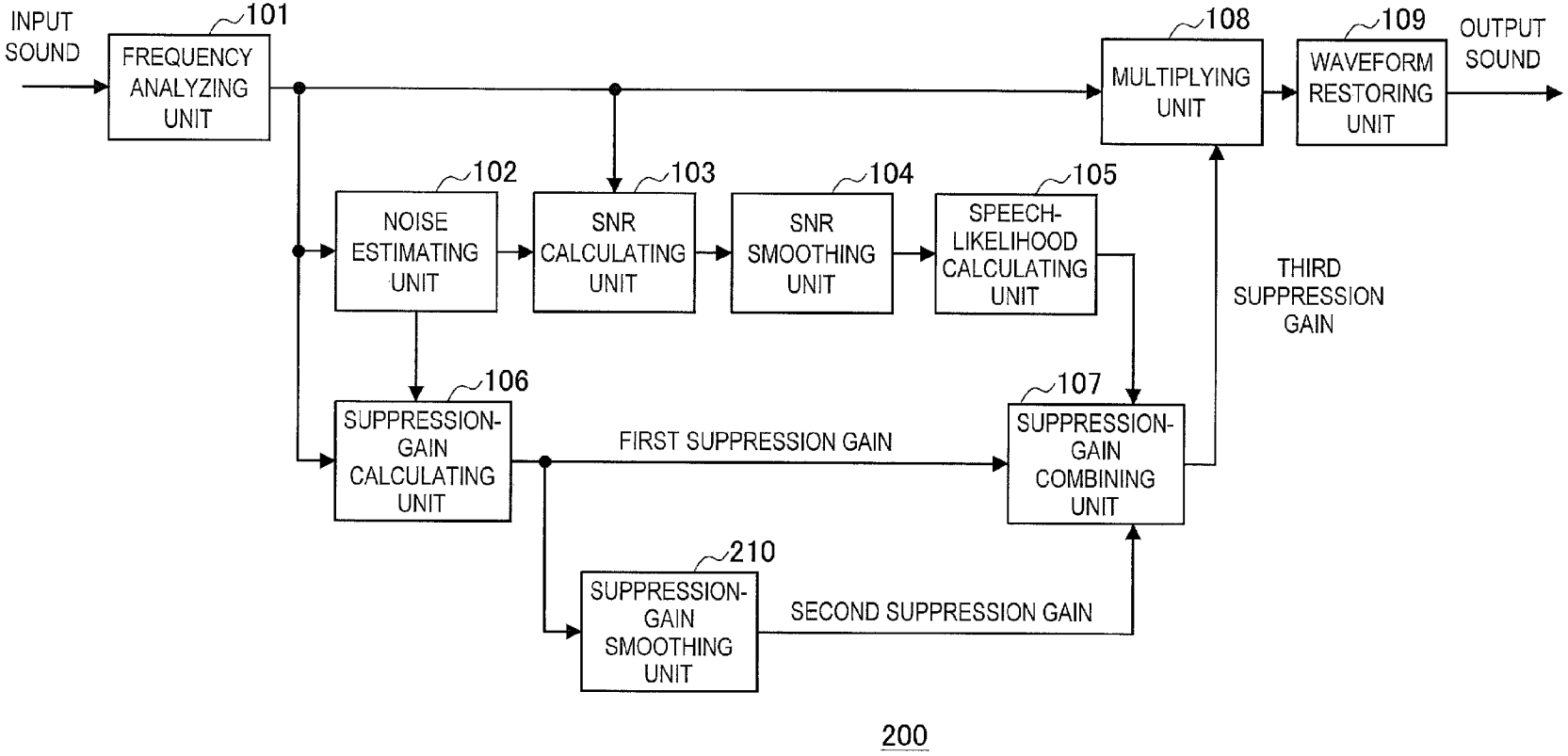
FIG. 3 is a block diagram illustrating an internal configuration of a noise suppressing device according to a second embodiment.

FIG. 3 is a block diagram illustrating an internal configuration of a noise suppressing device 200 according to the second embodiment.

In FIG. 3, the noise suppressing device 200 according to the second embodiment has a frequency analyzing unit 101, a noise estimating unit 102, an SNR calculating unit 103, an SNR smoothing unit 104, a speech-likelihood calculating unit 105, a suppression-gain calculating unit 106, a suppression-gain combining unit 107, a multiplying unit 108, a waveform restoring unit 109, and a suppression-gain smoothing unit 210.

In FIG. 3, components identical to or corresponding to those included in the noise suppressing device 100 in FIG. 1 according to the first embodiment are given the same reference characters. The second embodiment is different from the first embodiment in having the suppression-gain smoothing unit 210.

In FIG. 3, the suppression-gain calculating unit 106 calculates first suppression gain in a manner similar to the first embodiment. The obtained first suppression gain is supplied to the suppression-gain combining unit 107, as in the first embodiment, and is also supplied to the suppression-gain smoothing unit 210.

The suppression-gain smoothing unit 210 smooths the first suppression gain calculated by the suppression-gain calculating unit 106 along both the frequency-axis direction and the time-axis direction so as to calculate second suppression gain. Moreover, the suppression-gain smoothing unit 210 supplies the obtained second suppression gain to the suppression-gain combining unit 107.

(B-2) Operation of Second Embodiment

Next, the noise suppressing method in the noise suppressing device 200 according to the second embodiment will be described in detail with reference to the drawings. In the following description, the operation described in detail in the first embodiment will be omitted, and characteristic operation in the noise suppressing method according to the second embodiment will be described in detail.

The suppression-gain calculating unit 106 calculates first suppression gain in a manner similar to the first embodiment. The obtained first suppression gain is supplied to the suppression-gain combining unit 107 and the suppression-gain smoothing unit 210.

The suppression-gain smoothing unit 210 smooths the first suppression gain along both the frequency-axis direction and the time-axis direction so as to calculate second suppression gain. In order to calculate suppression gain having a property that does not cause distortion to occur at all, the suppression-gain smoothing unit 210 calculates the second suppression gain by sufficiently smoothing the first suppression gain along both the frequency-axis direction and the time-axis direction.

With regard to the smoothing method by the suppression-gain smoothing unit 210, the same method as the smoothing method in the SNR smoothing unit 104 described above is preferably used. Alternatively, a method different from that in the SNR smoothing unit 104 may be used. For example, for smoothing along the frequency-axis direction, the suppression-gain smoothing unit 210 may employ a method of calculating an average value of the first suppression gain of all frequency bands and applying the obtained average value to each frequency band. Although the use of this method is a good selection since the method involves a small calculation amount and causes minimal distortion, since a difference in magnitude of the first suppression gain is often large between a low frequency band (particularly, 100 Hz to 400 Hz having a pitch frequency of a speech component) and a high frequency band (e.g., 3 kHz or higher), it is more desirable that this difference in magnitude of the first suppression gain be reflected on the second suppression gain.

If the method used for smoothing along both the frequency-axis direction and the time-axis direction is the same as the smoothing method used by the SNR smoothing unit 104, the degree of smoothing may be set to a value substantially equal to or different from that in the SNR smoothing unit 104.

For example, if a moving average method is used for smoothing along the frequency-axis direction, the length of the smoothing window as the degree of smoothing is preferably set equivalent to about 500 Hz so as to perform the smoothing more intensely. If a time constant filter is used for smoothing along the time-axis direction, the value of the time constant as the degree of smoothing is preferably set to 0.9 or larger so as to perform the smoothing more intensely. In other words, in order to perform the smoothing more intensely, the suppression-gain smoothing unit 210 increases the degree of smoothing so as to calculate second suppression gain with a smoother, steady value.

The second suppression gain obtained in the suppression-gain smoothing unit 210 in the above-described manner is supplied to the suppression-gain combining unit 107.

Based on speech-likelihood $b_k$ from the speech-likelihood calculating unit 105, first suppression gain $G_k$ from the suppression-gain calculating unit 106, and smoothed second suppression gain $F_k$ from the suppression-gain smoothing unit 210, the suppression-gain combining unit 107 calculates third suppression gain for each frequency band by using, for example, equation (5). The obtained third suppression gain is supplied to the multiplying unit 108.

$$H_k=b_k \cdot G_k+(1-b_k)F_k \tag{5}$$

Because the second suppression gain $F_k$ is obtained by smoothing the first suppression gain $G_k$, the second suppression gain $F_k$ can be set as a value having the first suppression gain $G_k$ reflected thereon. Therefore, a difference in sound quality between a section where a speech component exists and a section where a speech component does not exist can be reduced, whereby sound with natural sound quality can be output.

(B-3) Effects of Second Embodiment

According to the second embodiment described above, the following effects can be achieved in addition to effects of the first embodiment.

According to the second embodiment, since second suppression gain is set based on first suppression gain, a difference in sound quality between a section where a speech component exists and a section where a speech component does not exist can be made smaller than that in the first embodiment, so that an output signal with more natural sound quality can be obtained.

Furthermore, in the case of the first embodiment, for example, when the MMSE-STSA method is used as the method for calculating first suppression gain, since the MMSE-STSA method does not have the concept of minimum suppression gain, an experiential skill is required for designing second suppression gain provided in advance as a constant value. In contrast, in the second embodiment, second suppression gain is automatically set in conjunction with first suppression gain, so that an output signal with natural sound quality can be obtained more easily.

(C) Other Embodiments

Although various modified embodiments have been mentioned in the above embodiments, the present invention is also applicable to the following modified embodiments.

(C-1)

Although a digital sound signal is input to the noise suppressing device in each of the above embodiments, an embodiment of the present invention can also be applied to a case where an input spectrum is input to the noise suppressing device. For example, in a case where a signal transferred from a counterpart device via a communication line is an input spectrum $X_k$, the input spectrum $X_k$ may be input to the noise suppressing device without being converted into a digital sound signal.

(C-2)

Although the noise suppressing device described in each of the above embodiments is based on the SS method, the noise suppressing device may be configured by combining the SS-method-based noise suppressing method and at least one of other noise suppressing methods (e.g., a Wiener filter and a coherence filter).

(C-3)

Although each of the above embodiments relates to a case where an input sound signal is input, a signal, such as music, may be input and a noise component included in the input signal may be suppressed by using the noise suppressing device according to one of the above embodiments.

Note that the noise suppressing method of the embodiments described above can be configured as the noise suppressing program. In the case of a noise suppressing program, the program that implements at least part of the noise suppressing method may be stored in a non-transitory computer readable medium, such as a flexible disk or a CD-ROM, and may be loaded onto a computer and executed. The recording medium is not limited to a removable recording medium such as a magnetic disk or an optical disk, and may be a fixed recording medium such as a hard disk apparatus or a memory. In addition, the program that implements at least part of the noise suppressing method may be distributed through a communication line (also including wireless communication) such as the Internet. Furthermore, the program may be encrypted or modulated or compressed, and the resulting program may be distributed through a wired or wireless line such as the Internet, or may be stored a non-transitory computer readable medium and distributed.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

What is claimed is:

1. A noise suppressing device for suppress a noise component included in an input signal, the noise suppressing device comprising:

a processor; and a non-transitory storage medium containing program instructions, execution of which by the processor causes the noise suppressing device to provide functions of a noise estimating unit configured to estimate a noise spectrum based on an input spectrum obtained by performing a frequency analysis on the input signal;

a speech-likelihood calculating unit configured to calculate speech-likelihood based on the input spectrum and the noise spectrum;

a suppression-gain calculating unit configured to calculate first suppression gain based on the input spectrum and the noise spectrum;

a suppression-gain combining unit configured to calculate third suppression gain by combining the first suppression gain and second suppression gain, which is provided as a predetermined constant value or provided by smoothing the first suppression gain, based on the speech-likelihood; and a multiplying unit obtaining an output spectrum by multiplying the input spectrum by the third suppression gain.

2. The noise suppressing device according to claim 1, wherein the speech-likelihood calculating unit calculates the speech-likelihood for each frequency band.

3. The noise suppressing device according to claim 1, wherein the execution of the program instructions by the processor causes the noise suppressing device to further provide functions of:

a speech-to-noise-ratio calculating unit configured to calculate a speech-to-noise-ratio based on power of the input spectrum and power of the noise spectrum; and a speech-to-noise-ratio smoothing unit configured to calculate a smoothed speech-to-noise-ratio by smoothing the speech-to-noise-ratio along both a frequency-axis direction and a time-axis direction, wherein the speech-likelihood calculating unit calculates the speech-likelihood based on the smoothed speech-to-noise-ratio.

4. The noise suppressing device according to claim 3, wherein the speech-likelihood calculating unit converts the smoothed speech-to-noise-ratio into the speech-likelihood by using a predetermined weakly-monotonically-increasing nonlinear function.

5. The noise suppressing device according to claim 4, wherein in the predetermined weakly-monotonically-increasing nonlinear function, a range of the speech-likelihood is between 0 and 1.

6. The noise suppressing device according to claim 1, wherein the suppression-gain combining unit adds a value, which is obtained by multiplying the first suppression gain by the speech-likelihood, to a value, which is obtained by multiplying the second suppression gain by a value obtained by subtracting the speech-likelihood from 1, so as to calculate the third suppression gain.

7. The noise suppressing device according to claim 1, wherein the execution of the program instructions by the processor causes the noise suppressing device to further provide functions of:

a suppression-gain smoothing unit configured to calculate the second suppression gain by smoothing the first suppression gain along both a frequency-axis direction and a time-axis direction.

8. A noise suppressing method for suppressing a noise component included in an input signal, the noise suppressing method comprising:

causing a noise estimating unit to estimate a noise spectrum based on an input spectrum obtained by performing a frequency analysis on the input signal;

causing a speech-likelihood calculating unit to calculate speech-likelihood based on the input spectrum and the noise spectrum;

causing a suppression-gain calculating unit to calculate first suppression gain based on the input spectrum and the noise spectrum;

causing a suppression-gain combining unit to calculate third suppression gain by combining the first suppression gain and second suppression gain, which is provided as a predetermined constant value or provided by smoothing the first suppression gain, based on the speech-likelihood; and causing a multiplying unit to obtain an output spectrum by multiplying the input spectrum by the third suppression gain.

9. A non-transitory computer-readable recording medium storing a noise suppressing program for suppressing a noise component included in an input signal, the noise suppressing program containing program instructions for causing a computer to perform steps of:

estimating a noise spectrum based on an input spectrum obtained by performing a frequency analysis on the input signal;

calculating speech-likelihood based on the input spectrum and the noise spectrum;

calculating first suppression gain based on the input spectrum and the noise spectrum;

calculating third suppression gain by combining the first suppression gain and second suppression gain, which is provided as a predetermined constant value or provided by smoothing the first suppression gain, based on the speech-likelihood; and obtaining an output spectrum by multiplying the input spectrum by the third suppression gain.

* * * * *